US005288202A

United States Patent [19]

Mancinelli, deceased

[11] Patent Number: 5,288,202

[45] Date of Patent: Feb. 22, 1994

[54] CENTRIFUGAL REGULATOR DEVICE FOR OPENING AND CLOSING THE SHUTTER OF AN AXIAL ELECTRIC FAN UNIT AND AN ELECTRIC FAN UNIT UTILIZING THIS DEVICE

[75] Inventor: Vittorio Mancinelli, deceased, late of Imperia, Italy, by Rosella Mancinelli, and Emilio Mancinelli, heirs

[73] Assignee: Euroemme S.P.A., Borgomaro, Italy

[21] Appl. No.: 41,043

[22] Filed: Mar. 31, 1993

[30] Foreign Application Priority Data

Apr. 1, 1992 [IT] Italy ..... T092A000295

[51] Int. Cl.[5] ..... F04D 25/14; F04D 25/08

[52] U.S. Cl. ..... 415/25; 415/211.2; 454/353

[58] Field of Search ..... 415/25, 125, 211.2; 454/353

[56] References Cited

U.S. PATENT DOCUMENTS

| | | | |
|---|---|---|---|
| 2,141,923 | 12/1938 | McMahan | 454/351 |
| 2,468,366 | 4/1949 | Habinski | 454/353 |
| 2,489,446 | 11/1949 | Biancani | 454/353 |
| 2,917,227 | 12/1959 | Ruegsegger | 146/52 |
| 3,699,873 | 10/1972 | Irvin | 415/125 |
| 4,217,816 | 8/1980 | Mancinelli | 415/125 |
| 4,743,739 | 5/1988 | Tateishi | 415/125 |

FOREIGN PATENT DOCUMENTS

| | | |
|---|---|---|
| 1051453 | 2/1959 | Fed. Rep. of Germany . |
| 2323957 | 8/1977 | France . |
| 814398 | 6/1959 | United Kingdom . |

*Primary Examiner*—Edward K. Look
*Assistant Examiner*—Michael S. Lee
*Attorney, Agent, or Firm*—Sughrue, Mion, Zinn, Macpeak & Seas

[57] ABSTRACT

A centrifugal regulator device for opening and closing the pivoted-vane shutter associated with an electric fan unit, has a base element connected for rotation with the fan and an actuator member guided for movement towards and away from the base element by apertured appendages slidingly coupled with corresponding guide rods fixed to the base element and extending parallel to and spaced from the axis of rotation of the fan, the actuator member being connected to the base element by means of at least two pivoted arms each including a centrifugal mass and cooperating, in the fully open position of the vanes with mechanical end stop members.

7 Claims, 7 Drawing Sheets

PRIOR ART

CENTRIFUGAL REGULATOR DEVICE FOR OPENING AND CLOSING THE SHUTTER OF AN AXIAL ELECTRIC FAN UNIT AND AN ELECTRIC FAN UNIT UTILIZING THIS DEVICE

DESCRIPTION

The present invention relates to centrifugal regulator devices intended to be mounted on axial electric fan units having a shutter which shuts off the passage for fluid in the fan duct, said devices being operable to control the opening and closure of the shutter.

More specifically, the invention relates to a centrifugal regulator device for opening and closing a system of vanes of a shutter of an electric fan unit, comprising:

- a base element adapted to be connected with a fan so as to rotate about an axis upon rotation of the fan.
- an axially movable actuator member adapted to be operatively connected to the system of vanes.
- at least two pivoted arms connecting said actuator member to said base element, said at least two pivoted arms each including a centrifugal mass and being displaceable in use, by the centrifugal effect due to the rotation of the base element about said axis in such a way as to cause the axial advancement or retraction of the actuator member, and
- guide means for guiding the axial movement of said actuator member.

In the known art, described in U.S. Pat. No. 4,217,816 by the same Applicant, the guide means are constituted by a central pin fixed to the movable member and housed slidably within a hollow shaft carried co-axially of the base element.

This type of guide requires that the base element is apertured and fixed to a hollow shaft which transverses the fan and is connected to the shaft which receives the drive from the electric motor.

The fan unit must therefore, necessarily, have a conformation such that it is pre-arranged to be coupled to the centrifugal device and vice versa and, in particular, cannot be applied to fans having electric motors directly coupled to the fan axis.

Moreover, the coaxial, slidable coupling between the central pin and the corresponding hollow shaft requires a precise coupling with the interposition, in general, of a support sleeve of anti-friction material, for example a copper-based alloy.

Especially in dusty atmospheres this type of coupling requires frequent and accurate maintenance in order to avoid excessive wear and jamming.

In another arrangement, described in European Patent Application No. 91203126.7, it has been proposed that the slidable coupling be eliminated and the guide formed by the use of at least three pivoted arms provided with centrifugal masses.

This arrangement is more complex and more expensive and, moreover, requires the three arms to be constructed and assembled with respect to the base element and to the movable element in an extremely accurate manner in order to avoid dynamic imbalances which, due to the presence of the centrifugal masses, could cause noise, vibration and instability.

The object of the present invention is to provide a centrifugal regulation device of the above specified type in which, however, the guide for the relative axial sliding of the base element and the movable member is formed in such a way as to avoid the functional and constructional problems described above.

In order to achieve this object the subject of the invention is a centrifugal regulator device for opening and closing a system of vanes of a shutter of an electric fan unit of the type specified above, characterised in that the means for guiding the axial movement of the actuator member include at least one guide rod fixed to the base element and extending therefrom towards said actuator member, said guide rod being parallel to and spaced from the axis of rotation of the base element and a corresponding at least one appendage fixed to said actuator member and provided with a shaped aperture for coupling slidably with the corresponding said guide rod.

The invention will now be described with reference to the appended drawings, given by way of non limitative example, in which.

Figure 1:
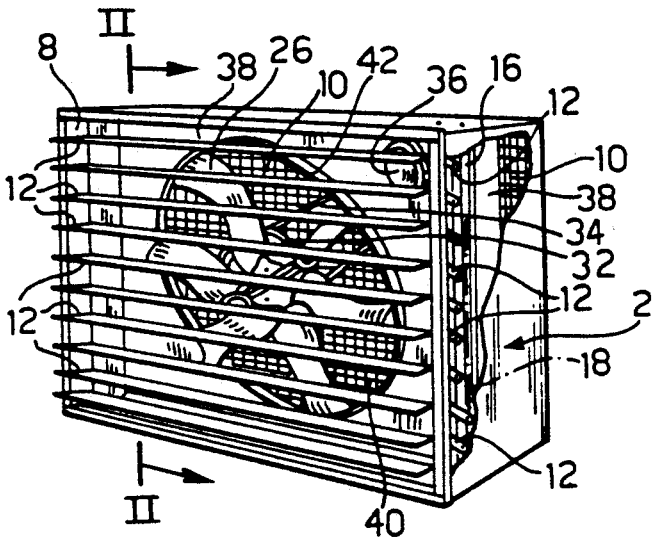
FIG. 1 is a perspective view of a prior art electric fan unit.
Figure 2:
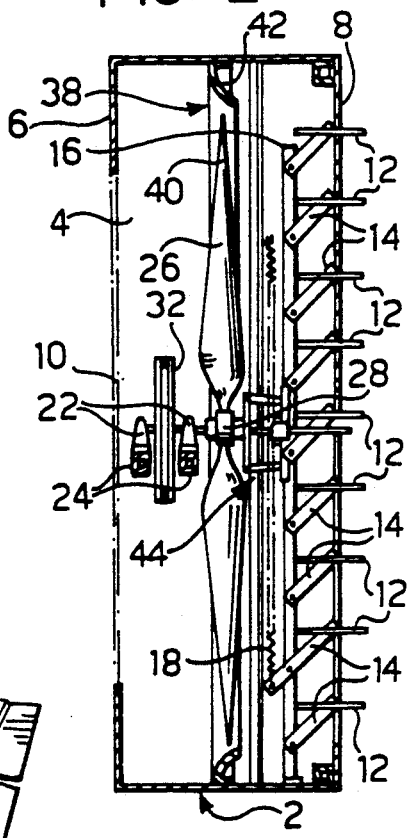
PRIOR ART FIG. 2
FIG. 2 is a sectional view taken on the line II—II of FIG. 1.

FIGS. 1 to 4 illustrate the electric fan unit which is known from U.S. Pat. No. 4,127,816 by the same inventor. With reference to these drawings, the electric fan unit comprises a casing 2 constituted by a rectangular hollow body defining a passage 4 for the flow of air. Two opposite walls of the casing 2 have apertures 6, 8 which respectively form an inlet and an outlet for the flow of air. The inlet 6 is provided with a metal mesh 10 which prevents extraneous bodies from entering the casing 2. The outlet 8 is provided with a shutter including a system of simultaneously controllable pivotable vanes 12. Each vane is pivotally supported at its ends by two opposite walls of the casing 2 and is also provided at one of its ends with a small link rod 14 which has one end fixed to the vane and the other end connected pivotally to a vertical connection bar 16. In this way all the vanes 12 are interconnected by means of the rod 16 so that it is possible to move only one of the vanes in order to cause all the vanes 12 to move. One of the link rods 14 has an elongate portion 14*a* which is connected to one end of a spring 18. The other end of the spring 18 is fixed to a wall of the casing 2 so that the rod 16 is thrust upwardly and all the vanes 12 are maintained in a configuration which completely closes the outlet 8. Again in the case of the known device illustrated in FIGS. 1 to 4, a hollow shaft 20 (FIG. 4) is pivotally supported by two bearings 22 (FIG. 2) which are fixed to two cross members 24. Each cross member 24 is supported by two opposite walls of the casing 2. A fan 26 is mounted on the hollow shaft 20. The fan 26 has a hub 28 (see also FIG. 4) which can be fixed to the shaft 20 by means of a screw 30. A pulley 32 is also fixed to the shaft 20 and is connected by a belt 34 to an electric drive motor 36 within the casing 2 (see FIG. 1). The casing 2 also has an internal wall 38 which is disposed in the same plane as the fan 26. The internal wall 38 has a circular aperture 40 with a rim 42 which surrounds the fan 26. A centrifugal regulator device 44 is mounted at the end of the shaft 20 opposite the pulley 32. The regulator 44 comprises a channel-shape bar 46 (see FIG. 3) having a hub 48 at its centre arranged with its axis orthogonal to the bar 46. The hub 48 is fixed to the hollow shaft 20 by means of a screw 50. Two arms 52 are connected pivotally to the ends of the bar 46. The ends of the arms 42 which are opposite the bar 46 are connected by two pivoted rods 54 to two lateral portions 56*a* of an actuator member 56. The member 56 has a central hole 58 in which a guide rod 60 is press fitted. The guide rod 60 is slidably mounted within the hollow shaft 20 so that the actuator member 56 can move only in a direction which coincides with the axis of the hollow shaft 20.

Figure 3:
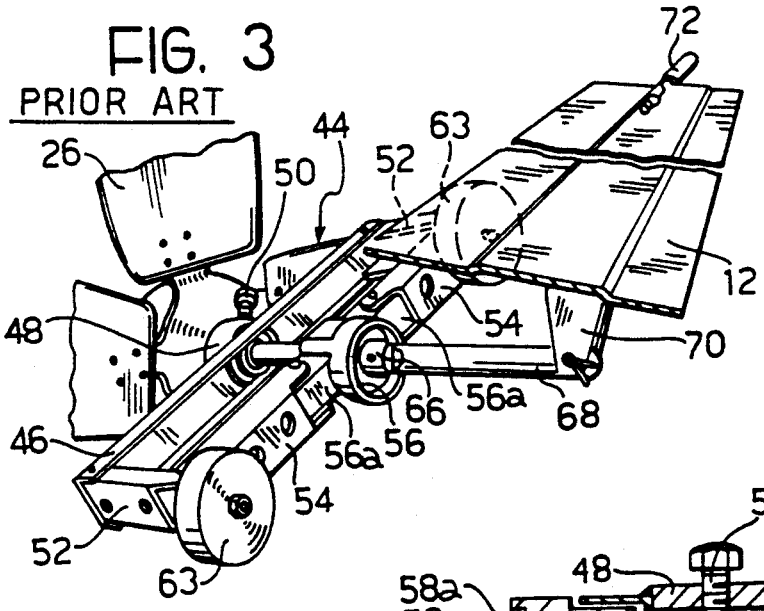
FIG. 3 PRIOR ART
FIG. 3 is a perspective view illustrating the prior art regulator device.

An anti-friction bushing 62 is interposed between the shaft 20 and the rod 60. Two centrifugal masses 63 are fixed to the ends of the pivoted rods 54. The central hole 58 of the actuator member 56 has an enlarged part 58*a* housing a rolling element bearing 64 which supports a pin 66. The pin can therefore follow the axial movement of the actuator member 56 without being constrained to rotate by the centrifugal regulator 44. An actuating rod 68 is connected to the pin 66 at one of its ends and to a fork 70 connected to one of the vanes 12 at its other end. In FIG. 3 the reference numeral 72 indicates one of the support pins fixed to each end of each vane 12 to form pivotal connection of the vanes to the casing 2.

Figure 4:
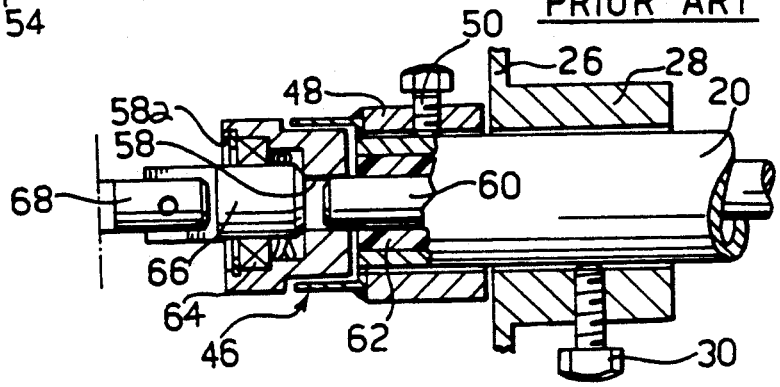
FIG. 4 PRIOR ART
FIG. 4 is a sectional view of the known device of FIG. 3.

In the said known device, the actuator member 56 is displaceable between a position adjacent the hub 48, illustrated in FIG. 4, corresponding to the inactive condition of the fan, and the position illustrated in FIG. 3 corresponding to the operative condition of the fan. The member 56 is thus displaced axially from the position shown in FIG. 4 to the position of FIG. 3 by the centrifugal effect of the masses 63 caused by the rotation of the fan. This axial displacement causes a corresponding displacement of the vanes 12 from the completely closed configuration to the completely open configuration.

Figure 5:
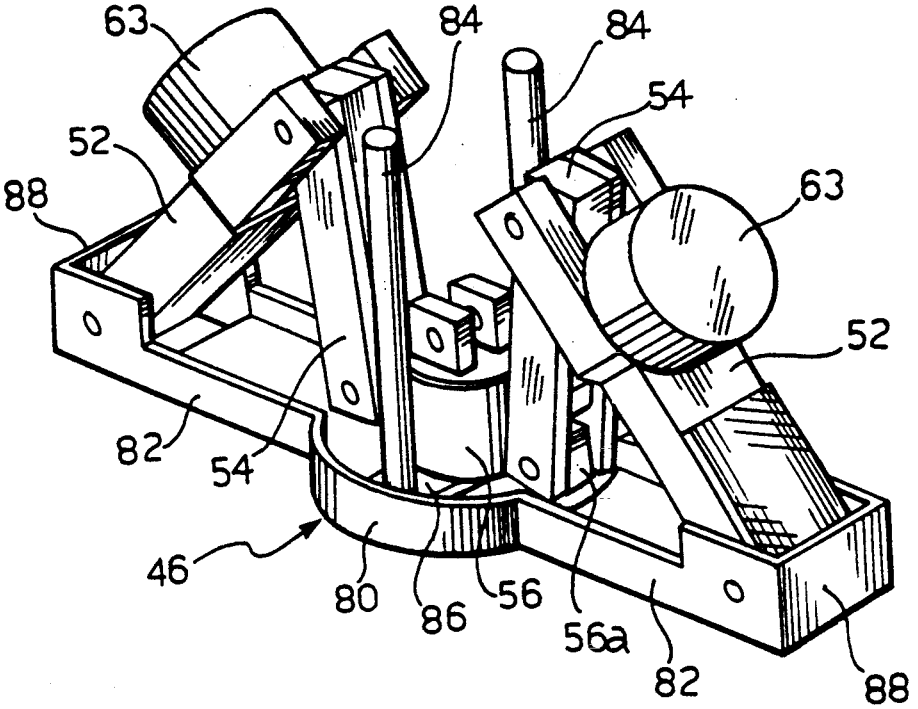
FIGS. 5 and 6 are two perspective views which illustrate a first embodiment of the device according to the present invention in two different operating conditions.
Figure 6:
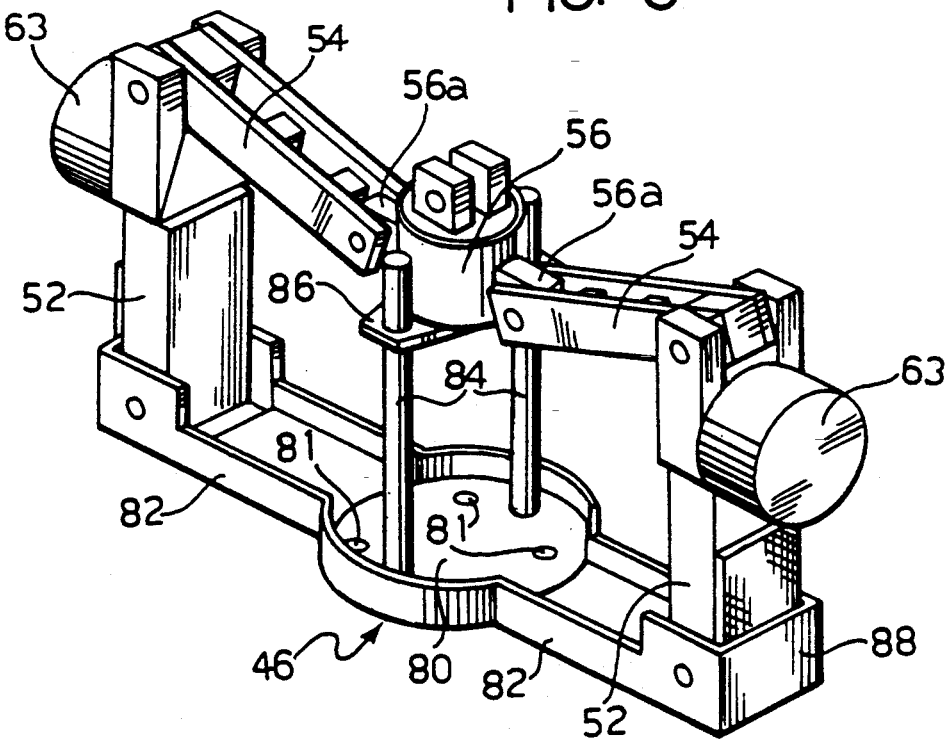
Figure 7:
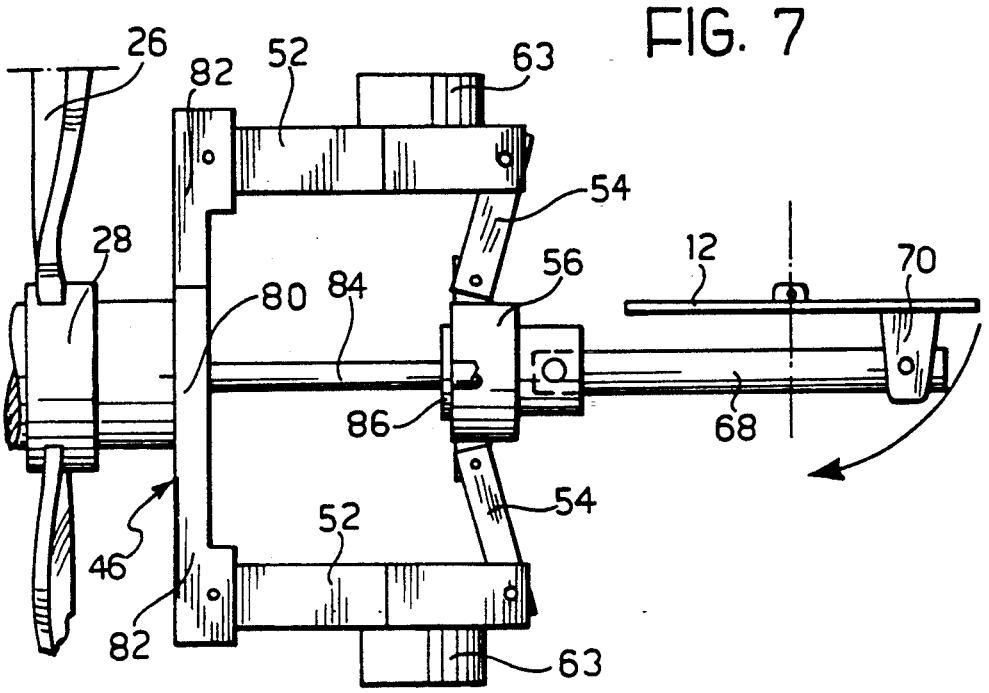
FIG. 7 is a side view of the device illustrated in FIG. 6.

FIGS. 5, 6 and 7 illustrate the centrifugal regulator device utilised in the electric fan unit according to a first embodiment of the present invention. In these drawings parts corresponding to those of FIGS. 3 and 4 have been indicated by the same reference numerals. In the case of FIGS. 5, 6 and 7, the element 46 constituting the base element of the regulator device is constituted by a disc 80 provided with holes 81 for receiving fixing screws for securing it to the fan and by two opposing radial arms 82 the ends of which are connected to the pivoted arms 52 to which the centrifugal masses 63 are connected. Two cylindrical guide rods 84 are fixed to the disc 80 so as to be parallel to and spaced from the axis of rotation of the fan and extend away from the fan itself. Two appendages 86 are fixed to the actuator member 56 and have respective circular holes whereby they are slidably assembled on the guide rods 84. The radially outermost ends of the radial arms 82 have two end-stop elements 88 for determining an abutment stop for the pivoted arms 52 so as to provide a mechanical end stop which makes the system self-centering in the condition illustrated in FIG. 6, corresponding to the fully open position of the vanes 12. The centrifugal regulator device illustrated in FIGS. 5, 6 and 7 operates in a thrust manner, that is to say, the centrifugal force acting on the masses 63 when the fan is driven causes the actuator member 56 to be displaced towards the vanes 12 in such a way that the actuating rod 68 thrusts the fork 70 outwardly of the fan causing the vanes 12 to open.

Figure 8:
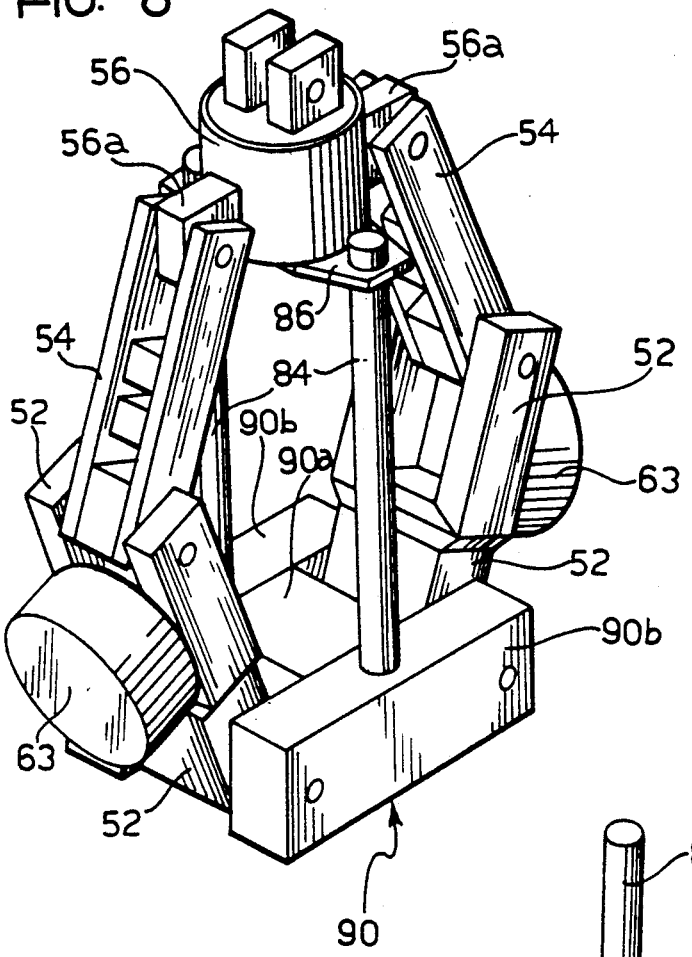
FIGS. 8 and 9 are two perspective views which illustrate a second embodiment of the device according to the present invention in two different operating conditions similar to those of FIGS. 5 and 6.
Figure 9:
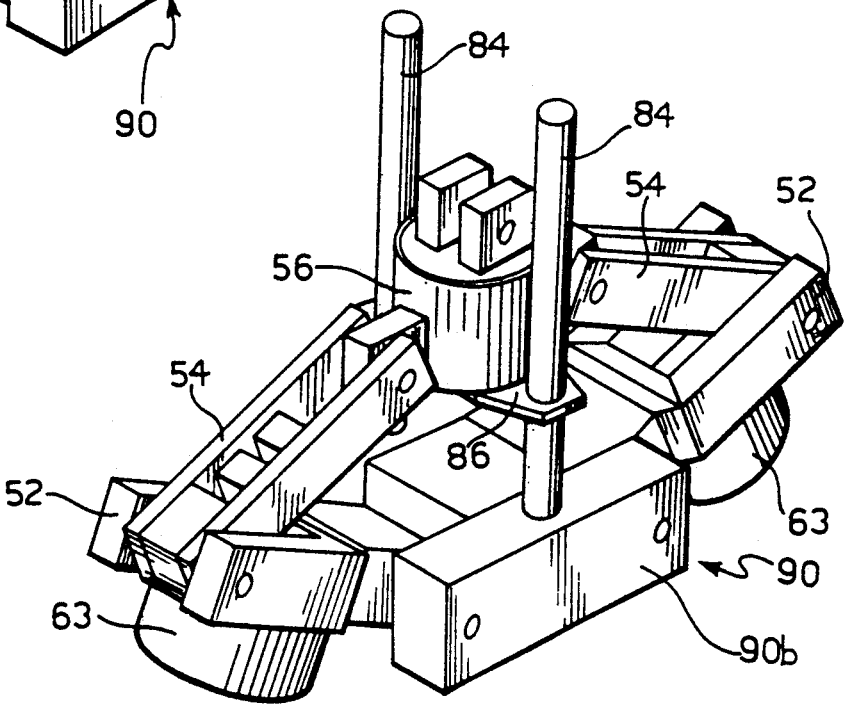
Figure 10:
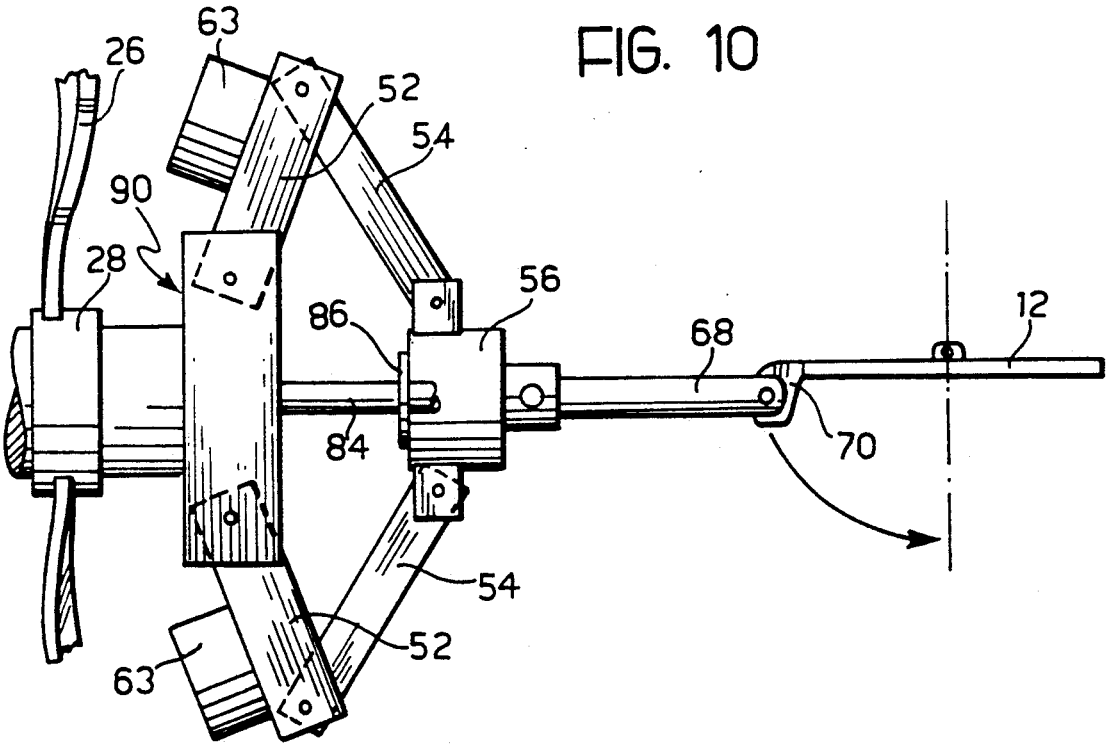
FIG. 10 is a side view of the device illustrated in FIG. 9.

A second embodiment of the regulator device according to the present invention is illustrated in FIG. 8, 9 and 10, in which the parts corresponding to those of FIGS. 3 to 7 are indicated by the same reference numerals. In the case of FIGS. 8, 9 and 10, the base element of the regulator device is constituted by a support 90 comprising a central portion 90*a* intended to be fixed to the fan and two lateral portions 90*b* on which the arms 52 are pivoted, and to which the guide rods 84 are connected. In this second embodiment, the regulator device is of the traction type, that is to say, the type in which rotation of the fan centrifuges the masses 63 to draw the actuator member 56 towards the support element 90 into the completely open condition of the vanes 12, as illustrated in FIG. 10. Naturally, in this case two end-stop elements can also be provided similar to those described for the first embodiment so as to provide a mechanical stop for the movement of the arms 52 into the completely open position of the vanes 12, therefore making the system self-centring.

Figure 11:
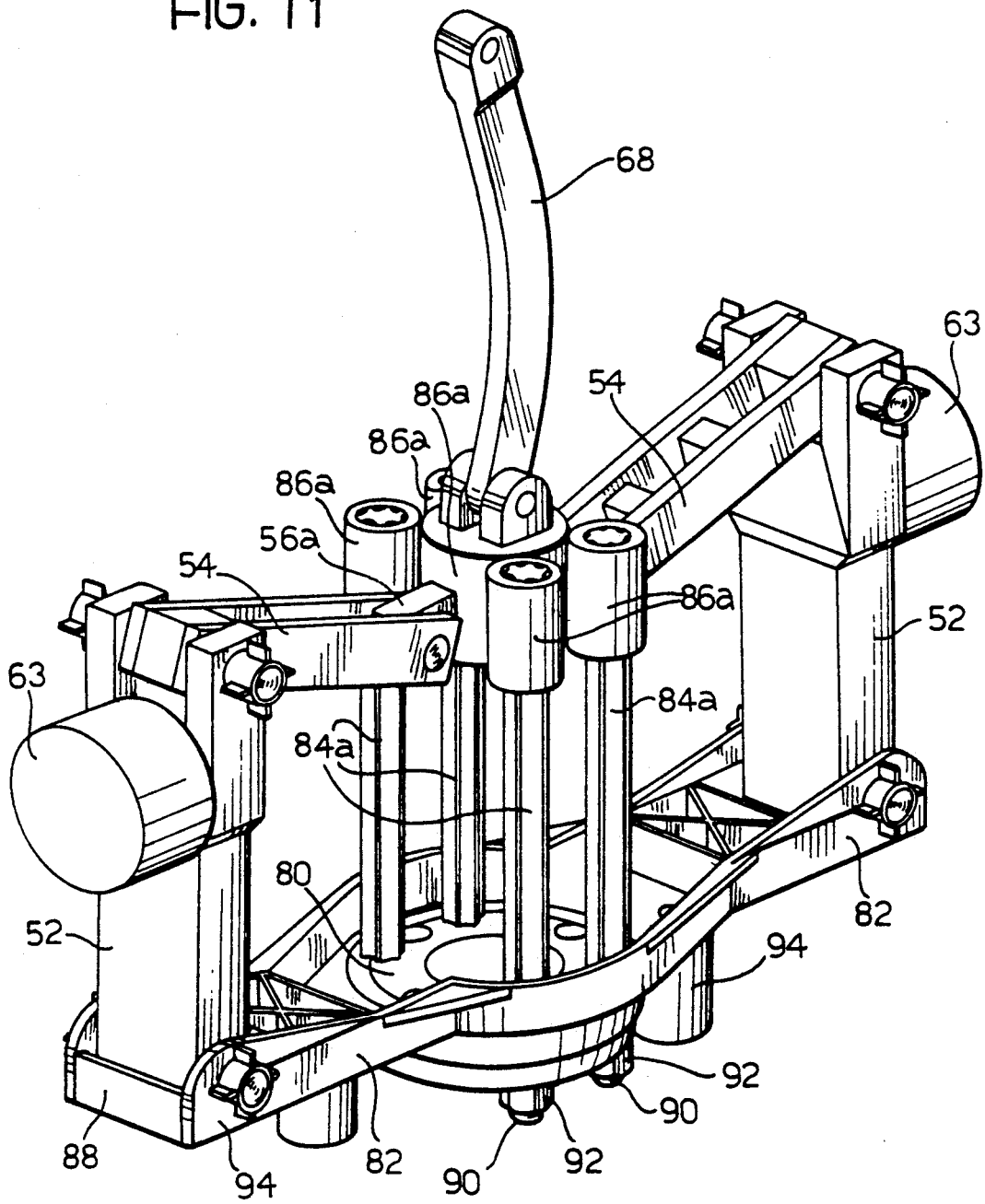
FIG. 11 is a perspective view of a third embodiment of the device according to the present invention.

A third embodiment of the regulator device according to the present invention is illustrated in FIG. 11, wherein the parts corresponding to those of FIGS. 3 to 7 are indicated by the same reference numerals. In the case of FIG. 11, four prismatic guide rods 84*a* are provided in couples which are specularly disposed with reference to a median plane defined as the locus of the centers of the masses 63 in their movement as a consequence of the movement of the arms 52. Four sleeve appendages 86*a* are connected to the member 56 for sliding on the respective prismatic guides 84*a*, the axial grooves resulting from the coupling between the outer prismatic surface of the guides 84*a* and the inner cylindrical surface of the appendages 86*a* reducing the risk of seizure or blocking of the guide assembly which could be provoked, for example, by dust, metal or plastic particles or thermal stresses.

Figure 12:
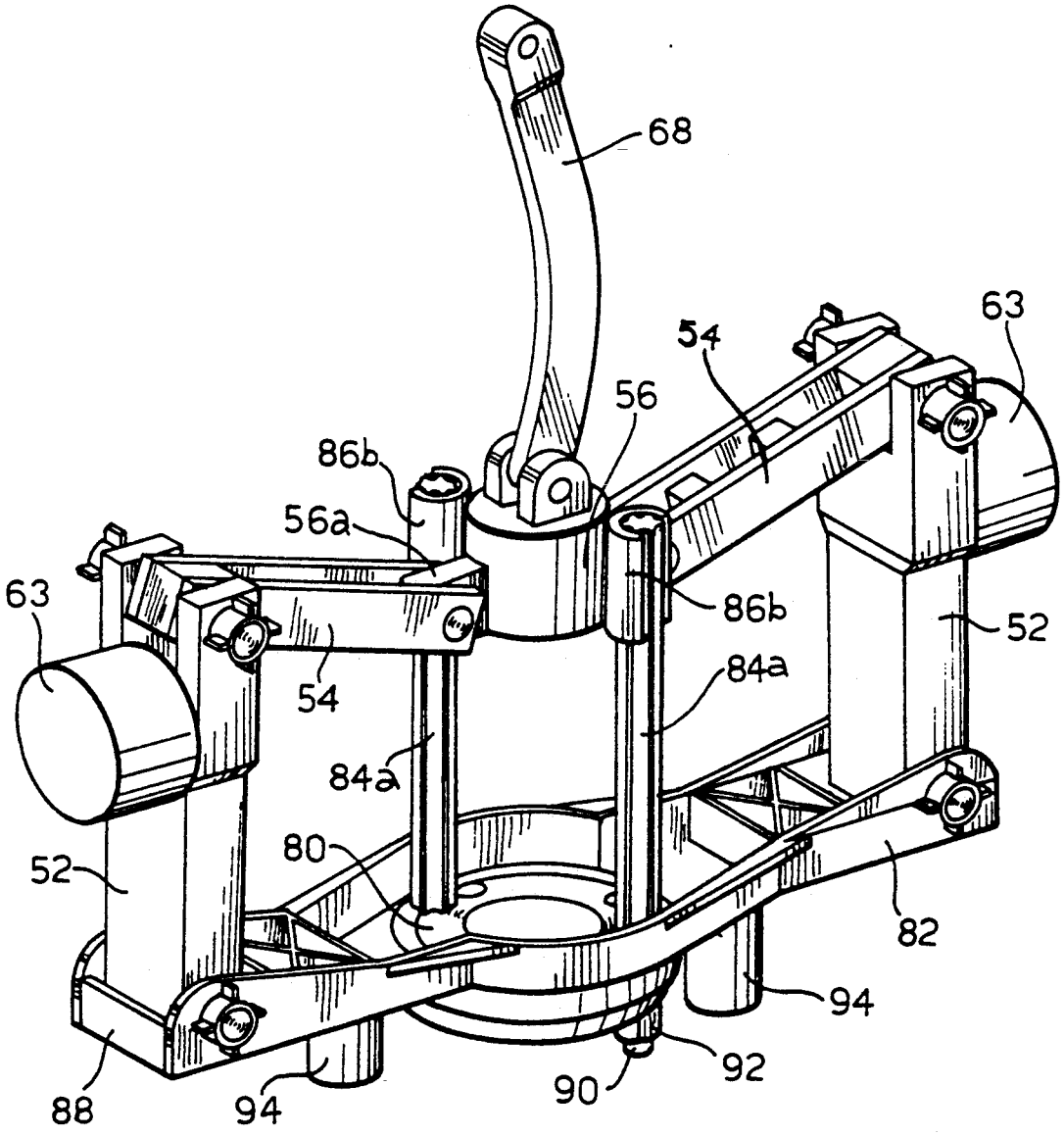
FIG. 12 is a perspective view of a fourth embodiment of the device according to the present invention.

FIG. 12 illustrates a fourth embodiment, wherein two prismatic guide rods 84*a* are provided for guiding, in a direction parallel to the axis of rotation of the fan, two respective sleeve appendages 86*b*. The appendages 86*b* are fixed to the member 56 and have partially-open peripheries so as to show C-like cross sections. This geometry is particularly suited in heavily polluted or dusty atmospheres, where the prevention of seizure or blocking is accomplished.

Figure 13:
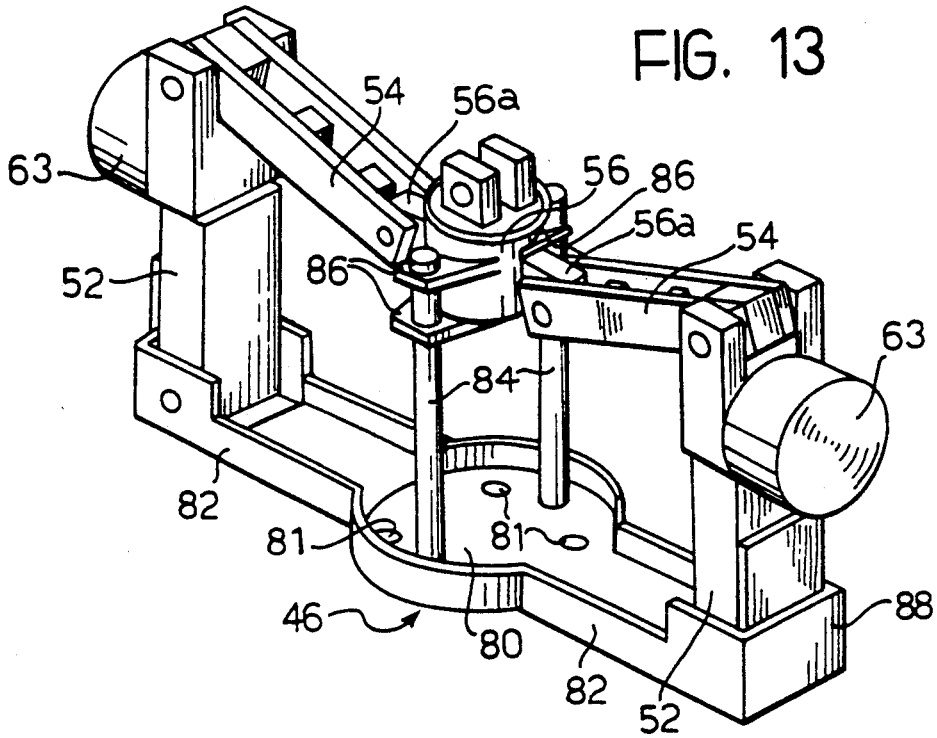
FIGS. 13 and 14 are two perspective views which respectfully illustrate a fifth and a sixth embodiment of the device according to the present invention.

FIG. 13 illustrates a variation of the device of FIGS. 5 to 7, wherein the same parts are indicated by corresponding reference numerals. The member 56 carries a total of four appendages 86 which are coupled in pairs to two guide rods 84. Each couple of appendages 86 which is slidably connected to the same guide rod 84 is constituted by two facing plates which are spaced apart along the axis of the guide rod 84 and have apertures of the same form, preferably circular (as shown in FIG. 13) or C-shaped.

Figure 14:
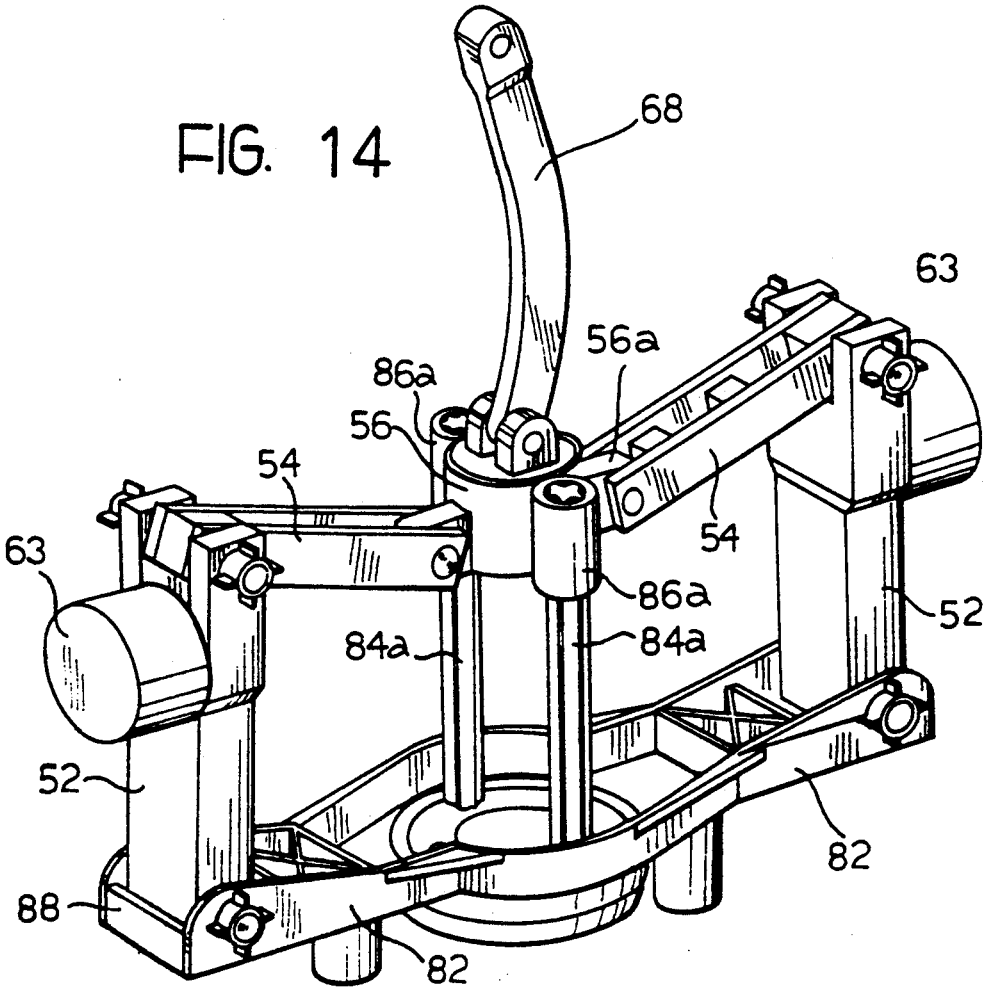

FIG. 14 illustrates a further variant of the centrifugal regulator device, wherein two prismatic guide rods 84*a* are situated on opposite sides with respect to the member 56 and are coupled with two respective cylindrical appendages 86*a* projecting from the peripheral surface of the member 56.

As shown in FIGS. 11 and 12, the holes 81 provided in the disc 80 of the device base element 46 can be adapted for receiving threaded ed portions 90 of the rods 84, 84*a*, which are secured to the disc 80 by means of nuts 92. Two spacers 94 project from the bottom surface of the radial arms 82 for bearing on respective surfaces of the fan unit (not shown in Figures). These spacers 94 may conveniently comprise a longitudinally extending hole for the insertion of additional screws or bolts for fixing the centrifugal device onto the fan unit.

The form and number of the guide rods 84 is not necessarily limited to what has been described and illustrated, it being possible to provide guide rods with different sections, for example prismatic or elliptic, and appendages 86 possibly constituted by a plurality of plates, facing but spaced apart and having apertures of corresponding form. Moreover, such shaped apertures 86 can have, at least for one of the appendages 86, partially-open peripheries so as to surround only part of the corresponding guide rods 84.

In a preferred embodiment, the arms 52, 54 are made of plastics material, each arm 52 integrally incorporating a casing which encloses a metal body which acts as the centrifugal mass.

The device according to the invention therefore makes it possible to solve the problems of jamming to which the slidable coupling between the guide rod 60 and the bush 62 of the known prior art device was subject in a very simple and effective manner, without at the same time prejudicing the correct axial movement of the actuator member 56.

Naturally, the principle of the invention remaining the same, the details of construction and the embodiments can be varied widely with respect to what has been described and illustrated purely by way of example, without by this departing from the ambit of the present invention.

What is claimed is:

1. A centrifugal regulator device for opening and closing a system of vanes of a shutter of an electric fan unit, comprising:

a base element adapted to be connected with a fan so as to rotate about an axis upon rotation of the fan, an axially movable actuator member adapted to be operatively connected to the system of vanes, at least two pivoted arms connecting said actuator member to said base element, said at least two pivoted arms each including a centrifugal mass and being displaceable, in use, by the centrifugal effect due to the rotation of the base element about said axis in such a way as to cause the axial advancement or retraction of the actuator member, and guide means for guiding the axial movement of said actuator member, wherein said guide means include at least one guide rod fixed to the base element and extending therefrom towards said actuator member, said guide rod being parallel to and spaced from said axis of rotation of said base element, and a corresponding at least one appendage fixed to said actuator member and defining a shaped aperture in which with said at least one guide rod, is slidably coupled.

2. A centrifugal regulator device according to claim 1, wherein it includes mechanical end-stop positioning means for cooperating with at least one of said at least two pivoted arms to stop its movement in a predetermined position in the operating condition corresponding to the maximum radial displacement of said masses during the rotation, in use, of said base element about said axis.

3. A centrifugal regulator device according to claim 1, wherein said guide means for guiding sliding movement include at least two said guide rods disposed on said base element in radially opposite positions with respect to said axis of rotation, said actuator member being provided with at least two said appendages each defining a respective shaped aperture slidably coupled with a respective one of said at least two guide rods.

4. A centrifugal regulator device according to claim 1, wherein said at least one appendage defines a said shaped aperture with a partially open outline such that said appendage only partly surrounds said at least one guide rod.

5. A centrifugal regulator device according to claim 1, wherein said at least one appendage is constituted by at least a pair of plates facing and axially spaced apart, each defining an identically shaped hole in an axially aligned position forming said shaped aperture of said appendage.

6. A centrifugal regulator device according to claim 1, wherein said at least one guide rod has a prismatic cross-section, said at least one corresponding appendage being axially elongated and defining an axially elongated aperture in which with said at least one guide rod, is slidably coupled.

7. An electric fan unit of the type comprising:

a casing defining at least an aperture for a flow of air, a fan mounted in the casing for rotation about its axis, and a shutter including a system of vanes displaceable between a fully-open configuration in which said aperture is open and a configuration completely closing the aperture, a centrifugal regulator device having a base element adapted to be connected with the fan so as to rotate about said axis upon rotation of the fan, an axially movable actuator member adapted to be operatively connected to the system of vanes to urge them towards said fully-open configuration when the fan is rotated, and at least two pivoted arms connecting said actuator member to said base element, said at least two pivoted arms each including a centrifugal mass and being displaceable, in use, by the centrifugal effect due to the rotation of the base element about said axis in such a way as to cause the axial advancement or retraction of the actuator member, and guide means for guiding the axial movement of said actuator member, wherein said guide means include at least one guide rod fixed to the base element and extending therefrom towards said actuator member, said guide rod being parallel to and spaced from said axis of rotation of said fan, and a corresponding at least one appendage fixed to said actuator member and defining a shaped aperture in which with said at least one guide rod, is slidably coupled.

* * * * *